United States Patent [19]

Kwasnitza

[11] 4,285,513

[45] Aug. 25, 1981

[54] METHOD AND APPARATUS FOR FORMING A STREAM OF PARTLY OVERLAPPING PAPER SHEETS OR THE LIKE

[75] Inventor: Hans-Dieter Kwasnitza, Neuffen, Fed. Rep. of Germany

[73] Assignee: De La Rue Giori S.A., Lausanne, Switzerland

[21] Appl. No.: 148,220

[22] Filed: May 9, 1980

Related U.S. Application Data

[63] Continuation of Ser. No. 910,066, May 26, 1978.

[30] Foreign Application Priority Data

Jun. 7, 1977 [DE] Fed. Rep. of Germany ..... 2725547

[51] Int. Cl.[3] ..... B65H 5/34

[52] U.S. Cl. ..... 271/270; 271/183; 271/199; 271/202

[58] Field of Search ..... 271/3, 182, 183, 199, 271/202, 203, 270

[56] References Cited

U.S. PATENT DOCUMENTS

| | | | |
|---|---|---|---|
| 3,178,174 | 4/1965 | Schneider | 271/183 |
| 3,232,605 | 2/1966 | Plummer | 271/183 |
| 3,941,374 | 3/1976 | Vits | 271/183 |

*Primary Examiner*—Richard A. Schacher
*Attorney, Agent, or Firm*—Kane, Dalsimer, Kane, Sullivan and Kurucz

[57] ABSTRACT

A first stream of non-overlapping spaced-apart sheets which move at a high speed is converted into a second stream of partially overlapping sheets by braking successive sheets of the first stream and deflecting the trailing portions of braked sheets laterally to enable the oncoming foremost sheets of the first stream to catch up with and partly overlap the preceding sheets. When the first stream exhibits a gap as a result of the absence of one or more sheets, or independently of the presence or absence of gaps, the deflection of the braked sheet is repeated at a location which is nearer to the braking station to thus insure that the trailing portion of the braked sheet preceding a gap is deflected laterally immediately before the sheet which follows the gap catches up therewith. The deflection of trailing portions which precede gaps in the first stream is effected by suction. The locus of such deflection can be shifted lengthwise of the path for the sheets in dependency on changes of the ratio of the speeds of first and second streams, on changes of the width of clearances between the sheets of the first stream and/or in dependency on changes of the length of sheets.

22 Claims, 3 Drawing Figures

METHOD AND APPARATUS FOR FORMING A STREAM OF PARTLY OVERLAPPING PAPER SHEETS OR THE LIKE

This is a continuation of application Ser. No. 910,066, filed May 26, 1978.

BACKGROUND OF THE INVENTION

The present invention relates to a method and apparatus for forming a stream of partly overlapping paper sheets or the like. More particularly, the invention relates to improvements in a method and apparatus for converting a first stream of discrete sheets which are spaced apart from each other into a second stream wherein the sheets overlap. Still more particularly, the invention relates to a method and apparatus for converting a first stream of discrete non-overlapping sheets or analogous commodities into a second stream wherein the commodities overlap regardless of whether or not certain commodities of the series of commodities which form the first stream are missing.

It is already known to convert a stream of rapidly moving discrete sheets into a stream of partly overlapping sheets. The apparatus which are utilized for such conversion employ a braking device which decelerates successive foremost sheets of the first stream and a mechanical deflector serving to flex the trailing end of the sheet which is subjected to the braking action so that the oncoming rapidly moving sheet of the first stream can catch up with and partially overlie or underlie the preceding sheet. The locus of deflection of successive braked sheets is ahead of the braking station, and the distance between such locus and the braking station corresponds to or approximates the length of a sheet.

The just described apparatus operate properly as long as the width of clearances between neighboring sheets of the first stream is uniform or deviates only negligibly from a standard width. In the absence of such uniformity of the width of clearances, the trailing portion of a sheet which is being braked can return into the path of the oncoming foremost sheet of the first stream before the foremost sheet advances sufficiently to overlap the preceding (braked) sheet. In other words, when the first stream exhibits a relatively wide gap which is due to the absence of one or more sheets, the just described apparatus are incapable of converting the first stream into a continuous stream of partly overlapping sheets. If the next-following sheet is permitted to strike against the rear edge of the preceding (braked) sheet, the sheets are likely to be deformed and/or otherwise damaged, and one or both sheets are likely to change orientation so as to interfere with orderly processing of sheets which form the second stream. Removal of certain sheets from the first stream is often necessary or desirable, e.g., for the purposes of insepction or to segregate defective sheets. Each such removal results in the formation of a gap in the stream of partly overlapping sheets or in a pileup of sheets at the braking station.

It was already proposed to utilize apparatus wherein the stream of partly overlapping sheets is temporarily arrested in response to detection of a gap in the stream of non-overlapping sheets. Such stoppage of the stream of overlapping sheets serves to enable the foremost sheet of the first stream to catch up with the last sheet of the second stream. The second stream is set in motion when its last sheet is overlapped by the oncoming rapidly advancing sheet of the first stream. The just described mode of operation is not entirely satisfactory, especially when the apparatus is to process sheets at a high speed and/or when the sheets are heavy and bulky (each sheet may constitute a single panel or leaf of paper or other flexible sheet material, or a stack of overlapping sheets, such as a note book, steno pad or the like). The braking and accelerating forces which must be applied to effect repeated stoppage and transport of the second stream are very pronounced and invariably cause extensive wear upon the components of the apparatus. The sheets of the second stream are likely to slip relative to their conveyor or conveyors and to thus change their orientation; this affects the operation of devices which receive the sheets of the second stream. Still further, such apparatus cannot prevent damage to the last sheet of the arrested second stream and/or to the foremost sheet of the first stream unless the deflection of the trailing portion of the last sheet of the second stream is timed with utmost accuracy. Therefore, the just described apparatus can function satisfactorily only as long as the speed of sheets is relatively low, namely, well below the speed which is required in a modern high-speed machine for the processing of paper sheets which are to be assembled into note books or the like.

OBJECTS AND SUMMARY OF THE INVENTION

An object of the invention is to provide a novel and improved method of converting a first stream of rapidly moving non-overlapping sheets into a second stream wherein the sheets overlap regardless of the extent to which the width of clearances or gaps between successive sheets of the first stream deviates from an anticipated width.

Another object of the invention is to provide a method which can be resorted to for conversion of a first stream wherein the width of gaps between certain sheets can exceed the length of one or more sheets into an uninterrupted second stream of overlapping sheets without any stoppage of the second stream.

A further object of the invention is to provide a novel and improved apparatus for the practice of the above outlined method, and to provide the apparatus with novel and improved means for effecting satisfactory overlapping of the last sheet of the stream of overlapping sheets by the foremost sheet of the stream of non-overlapping sheets regardless of the width of the clearance or gap between the just mentioned last and foremost sheets prior to deceleration of the last sheet.

An additional object of the invention is to provide the apparatus with novel and improved means for timely deflection of the trailing portions of those sheets which are separated from the next-following sheets by gaps whose width exceeds the length of a sheet.

An ancillary object of the invention is to provide an apparatus which can be readily adjusted to properly manipulate longer or shorter sheets, rapidly or slowly advancing sheets, sheets wherein the average width of clearances between neighboring sheets is constant or fluctuates within a certain range, and/or sheets which consist of discrete leaves or of stacks of superimposed leaves.

One feature of the invention resides in the provision of a method of forming a stream of partially overlapping flexible sheets or like commodities (hereinafter called sheets) which comprises the steps of transporting a series of discrete spaced-apart non-overlapping sheets at a relatively high first speed in a predetermined direction along a predetermined path, decelerating successive sheets of the series in a first portion of the path to a lower second speed whereby each sheet which follows the respective preceding sheet (namely, which follows the sheet that is located in the first portion of the path and is in the process of being decelerated to the second speed) catches up with the preceding sheet in a second portion of the path which is located upstream of the first portion, as considered in the aforementioned direction, deflecting the trailing portion of each preceding sheet from the path substantially immediately before the following sheet catches up therewith (i.e., the trailing portion of the preceding sheet must be deflected by timing its flexing in such a way that is does not reassume its normal position (in the path) before the leader of the following sheet catches up therewith) so that the leader of each following sheet overlies the trailing portion of the respective preceding sheet before the following sheet is decelerated in the first portion of the path, and deflecting the trailing portion of a decelerated sheet with a delay (i.e., at a time when the trailing portion is nearer to the first portion of the path) at least when the series of discrete sheets exhibits a gap as a result of the absence of at least one sheet in the series so that the trailing portion of the preceding sheet is deflected from the path substantially immediately before the sheet following the gap catches up therewith. This amounts to the provision of a second deflecting station between that station where the trailing portions of successive sheets are flexed regardless of whether or not the series of oncoming discrete sheets exhibits a gap and the station where the leaders of successive sheets enter the first portion of the path, i.e., where the leaders of sheets reach the device or devices which subject the sheets to a braking or decelerating action.

One of the deflecting steps may include mechanically deflecting the trailing portions of the preceding sheets, and the other deflecting step may include pneumatically diverting the trailing portions of preceding sheets from the path, e.g., by establishing a pressure differential at the opposite sides of such trailing portions. Pneumatic diversion is especially suited for deflecting of trailing portions of sheets which precede gaps in the series of discrete sheets. If the path is horizontal or nearly horizontal, the trailing portions of the sheets are preferably diverted downwardly.

The method may further comprise the step of shifting the locus of deflection of sheets which precede gaps in the series of discrete sheets in or counter to the aforementioned direction as a function of changes in the ratio of the first and second speeds, as a function of changes of the width of clearances between neighboring sheets of the series, and/or as a function of changes in the length of sheets.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with references to the accompanying drawing.

DESCRIPTION OF THE PREFERRED EMBODIMENTS

Figure 1:
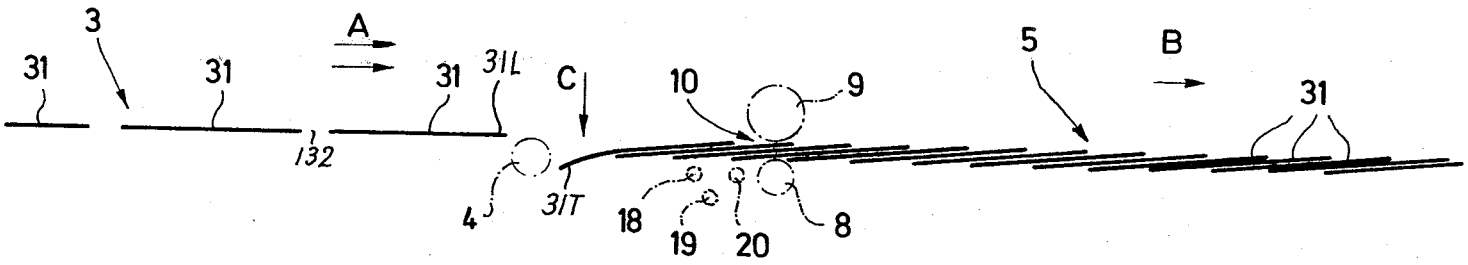
FIG. 1 is a schematic side elevational view of a path along which the first and second streams advance, and of certain components of the apparatus which serves to brake successive sheets and to deflect the trailing portions of sheets which are engaged by the braking means.
Figure 2:
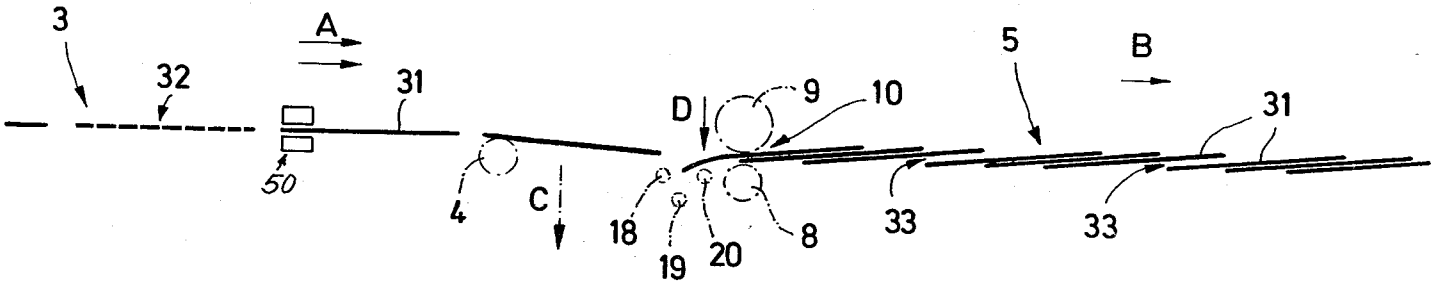
FIG. 2 is a similar view but showing the manner in which a braked sheet is treated when it is followed by a sheet that is separated therefrom by a gap having a width exceeding the length of a sheet.
Figure 3:
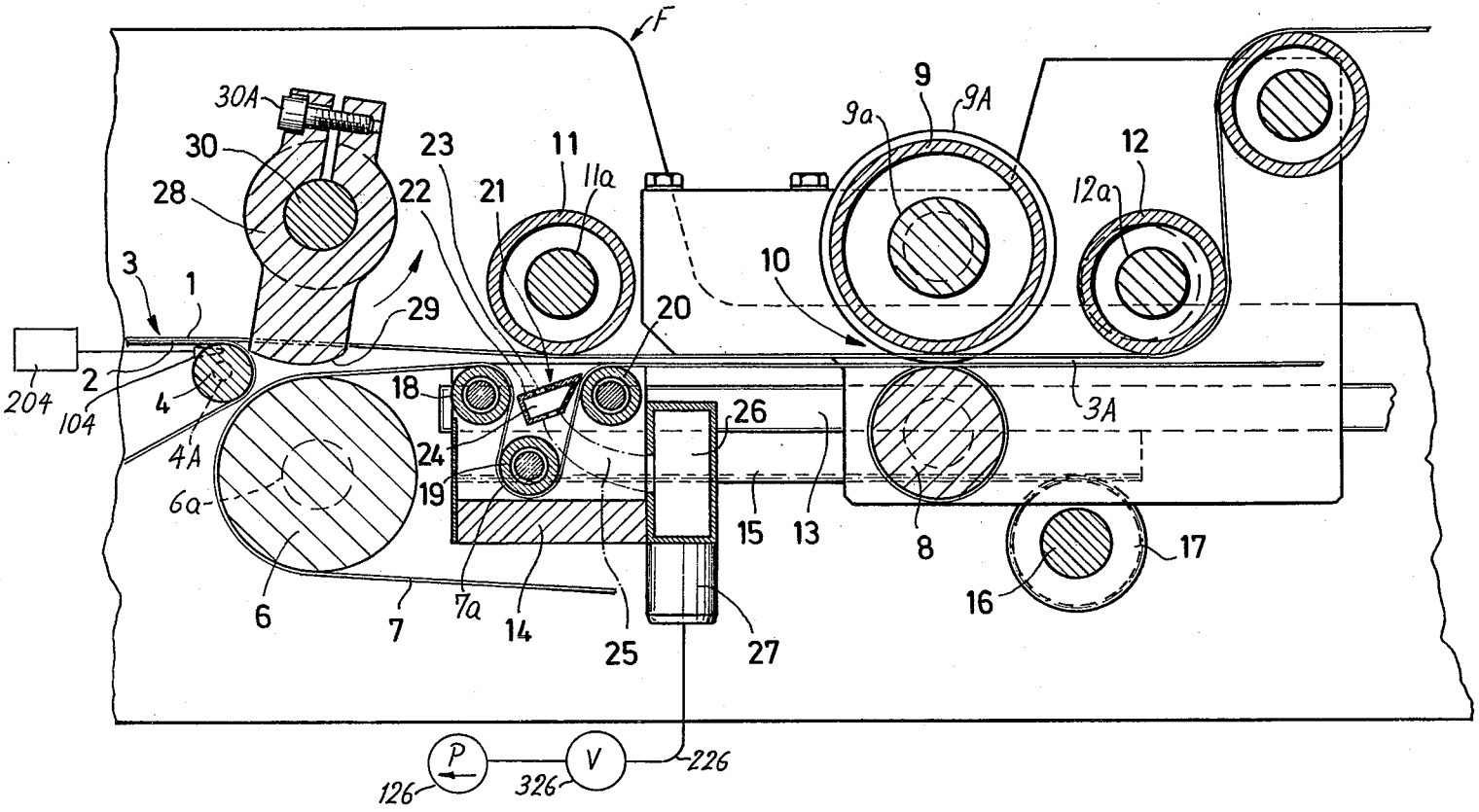
FIG. 3 is a fragmentary longitudinal vertical sectional view of an apparatus which can be utilized for the practice of my method and certain parts of which are shown in FIGS. 1 and 2 by phantom lines.

Referring first to FIG. 3, there is shown an apparatus which forms a (second) stream 5 of partly overlapping sheets 31 (such stream is shown in the right-hand portion of FIG. 1). The stream 5 is obtained by conversion of a series (first stream) of discrete sheets 31 which are separated from each other by relatively narrow and at least nearly uniform clearances 132 shown in the left-hand portion of FIG. 1. The first stream (of discrete non-overlapping sheets 31) is transported along an elongated path 3 which may but need not be horizontal. The path 3 is defined by a transporting system which includes endless belt conveyors 1, 2 and 7. These conveyors transport the sheets 31 in a direction from the left to the right, as viewed in FIGS. 1, 2 or 3. The conveyors 1 and 2 are driven at a high or relatively high speed (this is indicated by the two arrows A), and the conveyor 7 is driven at a lesser second speed (as indicated by the single arrow B). The rapidly advancing sheets 31 of the first stream are disposed between the lower reach of the conveyor 1 and the upper reach of the conveyor 2. The right-hand end portion of the upper reach of the conveyor 2 terminates at a pulley 4 but the lower reach of the conveyor 1 extends well beyond the pulley 4, namely, all the way to a guide roller 12 which causes the lower reach of the conveyor 1 to leave the path 3 on its way back to the inlet of the path 3 (in a manner not specifically shown in the drawing). The lower conveyor 7 is trained over a pulley 6 and its upper reach (save for the portion immediately adjacent to the pulley 6 and for the portion between two loop forming guide rolls 18, 20) extends in parallelism with the lower reach of the conveyor 2. The upper reach of the conveyor 7 extends beyond the guide roller 12 to support and advance the stream 5 of partly overlapping sheets 31 to the next processing station, e.g., to a stacker, not shown. The speed of the conveyor 7 may be a relatively small fraction of the speed of the conveyors 1 and 2.

A median portion of the upper reach of the conveyor 7 contacts the apex of a horizontal intermediate roller or drum 8 which is disposed below a roller or drum 9 mounted above the lower reach of the conveyor 1 slightly upstream of the guide roller 12. The drums 8 and 9 constitute a braking or decelerating device 10 which decelerates successive sheets 31 to the speed of the conveyor 7. These drums rotate in opposite directions at a peripheral speed which matches the speed of lengthwise movement of the conveyor 7. The lower reach of the conveyor 1 further contacts an adjustable guide roller 11 which is installed in the frame F of the apparatus intermediate the drum 9 and pulley 4. The shafts 11*a* and 12*a* for the guide rollers 11, 12 are eccentrically mounted in the frame F so that the lowermost points of the rollers 11 and 12 can be moved toward or away from the upper reach of the conveyor 7 by the simple expedient of changing the angular positions of the shafts 11*a*, 12*a* with respect to the frame F. As a rule, the positions of the shafts 11*a*, 12*a* will be selected in such a way that the lower reach of the conveyor 1 and the upper reach of the conveyor 7 define a relatively narrow channel 3A forming a portion of the path 3 and having a width which can slightly exceed the thickness of a sheet 31 (each sheet may constitute a single panel of paper or the like or a group or overlapping sheets such as a note book or pad). The shaft 9*a* of the drum 9, too, can be adjustably mounted in the frame F so that the width of the nip of the drums 8 and 9 can be changed, for example, to allow for manipulation of sheets having different thicknesses.

The frame F further supports a track 13 disposed below the upper reach of the conveyor 7 and serving to guide a reciprocable carriage or support 14 for the aforementioned loop forming rolls 18, 20 and a third loop forming or looping roll 19. The carriage 14 can be moved, in and counter to the direction of transport of sheets 31, by an adjusting device including a rack 15 which is rigid with the carriage and a pinion 17 meshing with the rack 15 and mounted on an adjusting shaft 16 which is journalled in the frame F. Thus, the carriage 14 can be shifted lengthwise of the upper reach of the conveyor 7 by rotating the shaft 16 in a clockwise or counterclockwise direction, as viewed in FIG. 3.

The upper reach of the conveyor 7 is trained over the rolls 18, 19 and 20 in such a way that it forms a loop 7A. The roll 19 is located in the bight of the loop 7A and is sufficiently remote from the path 3 to provide room for a pneumatic deflecting device here shown as a relatively narrow suction chamber 21 which extends transversely and is located at the underside of the path 3. The chamber 21 has a foraminous top wall 22 (the perforations or suction ports in the wall 22 are shown at 23) which slopes downwardly and rearwardly, i.e., counter to the direction of transport of sheets 31 along the path 3. The angle between the plane of a sheet 31 which is adjacent to the open upper side of the loop 7A and the plane of the foraminous top wall 22 is a relatively small acute angle (e.g., 25–35 degrees). The length of the suction chamber 21, as considered at right angles to the plane of FIG. 3, preferably equals or approximates the width of the path 3, i.e., the width of the conveyors 1 and 7. The internal space 24 of the suction chamber 21 is in communication with the interior of a suction manifold 26 (which is also mounted on the carriage 14) by way of a suction pipe 25. The nipple 27 of the manifold 26 is connected with a vacuum pump 126 or another suitable suction generating device by a flexible hose or conduit 226.

A valve 326 is installed in the conduit 226; this valve is normally closed so that the pressure in the internal space 24 of the chamber 21 normally equals atmospheric pressure. The valve 326 is preferably an electromagnetic valve whose solenoid can be energized to allow air to flow from the chamber 21 into the manifold 26 and thence into the pump 126 under certain circumstances which will be described in connection with FIG. 2.

The apparatus further comprises a mechanical deflecting device 28 which is a cam adjustably connected to a driven shaft 30 by a screw 30A and having a lobe with a suitably curved sheet-deflecting surface 29 whose center of curvature is not located on the axis of the shaft 30. The shaft 30 is driven in synchronism with the conveyors 1 and 2 (it can receive torque from one of the pulleys for the conveyor 1) so that it completes one revolution whenever a sheet 31 between the conveyors 1, 2 advances through a distance which is equal to that between the leading edges of two successive sheets 31 in a path portion upstream of the deflecting device 28. The latter is mounted on the shaft 30 in such angular position that its convex surface 29 engages and deflects the trailing portions 31T of successive sheets 31 while such sheets undergo deceleration from the speed of the conveyor 1 or 2 to the speed of the conveyor 7 under the action of drums 8, 9 which constitute the braking device 10. As mentioned above, the leftmost portion of the upper reach of the conveyor 7 is spaced apart from the path 3 (owing to appropriate mounting of the shaft 6*a* in the frame F so that the apex of the pulley 6 is spaced apart from the lower reach of the conveyor 1) in order to provide room for downward deflection of the trailing portions 31T of successive sheets 31.

The operation of the improved apparatus is as follows:

When the conveyors 1 and 2 deliver a series (first stream) of discrete spaced-apart non-overlapping sheets 31 which are separated from each other by clearances 132 of uniform or nearly uniform width, the conversion of such first stream into the second stream 5 takes place in a manner as shown in FIG. 1. Thus, the sheets 31 are rapidly advanced to a station C (occupied by the mechanical deflecting device 28) where the trailing portion 31T of each sheet 31 is deflected downwardly (i.e., laterally) toward the leftmost portion of the upper reach of the conveyor 7. The trailing portion 31T of a sheet 31 is deflected by the surface 29 at a time when the respective sheet 31 undergoes deceleration from the speed A to the speed B, i.e., while the leader 31L of such sheet passes between the drums 8, 9 of the braking device 10. This enables the next-following (rapidly advancing) sheet 31 to catch up with the preceding sheet, and the leader of the next-following sheet can slide over the freshly deflected trailing portion 31T of the preceding sheet. The valve 326 seals the internal space 24 of the chamber 21 from the pump 126 so that the chamber 21 cannot attract the adjacent portions of successive sheets 31 in that portion of the path 3 which extends between the looping rolls 18 and 20. As mentioned above, the angular position of the mechanical deflecting device 28 can be readily selected in such a way that the convex surface 29 engages the trailing portions 31T of sheets 31 which are in the process of being decelerated by the device 10, and the surface 29 moves out of the way practically instantaneously so as not to interfere with advancement of the leader 31L of the oncoming rapidly moving sheet 31 into a position of overlap with the trailing portion 31T of the preceding sheet. It will be noted that mechanical deflection of a trailing portion 31T immediately precedes the instant when the leader 31L of the next-following sheet catches up with and begins to overlap the deflected trailing portion.

The fact that the upper reach of the belt conveyor 2 does not extend all the way to the braking device 10 does not result in premature or unpredictable slowing down of sheets 31 which advance with the lower reach of the conveyor 1. This is due to the fact that the sheets 31 slide along the upper reach of the slower conveyor 7 and also because each sheet 31 normally accumulates an electrostatic charge and tends to adhere to the lower reach of the conveyor 1 while moving its leader 31L beyond the pulley 4 and on toward the braking or decelerating device 10. The conveyor 1 may consist (and preferably consists) of several discrete endless flexible elements which are disposed in parallel vertical planes and provide room for ring-shaped circumferential portions 9A of the upper braking drum 9 to directly engage the leaders 31L of sheets 31 which reach the nip of the drums 8 and 9. This results in predictable deceleration of successive sheets 31 so that the speed of such sheets is reduced from that of the conveyor 1 to that of the conveyor 7 (as mentioned above, the peripheral speeds of the drums 8 and 9 match the speed of the conveyor 7). The distance between the locus or path portion where the lobe of the mechanical deflecting device 28 engages the trailing portions of successive sheets 31 and the braking or decelerating station 10 can be readily selected in such a way that the leader 31L of a rapidly advancing oncoming sheet 31 overlies the trailing portion 31T of the sheet which is being braked by the drum 9 in cooperation with the conveyor 17 while the trailing portion of the braked sheet is still located at a level below the path 3 so as to provide room for forward movement of the leader of the next-following sheet. In other words, the leader of the foremost rapidly advancing sheet 31 can catch up with and overlap the trailing portion of the preceding (braked) sheet 31 immediately after the surface 29 moves upwardly and away from the path 3 (the mechanical deflecting device 28 is rotated in a counterclockwise direction, as viewed in FIG. 3). It has been found that the improved apparatus operates properly even if the width of clearances 132 between neighboring sheets which are transported by the conveyors 1 and 2 varies within a certain range. The distance between the leader of a rapidly advancing oncoming sheet 31 and the leader of the preceding sheet (namely, the next-to-the-last sheet of the stream 5) decreases as long as the leader of the rapidly advancing sheet travels toward the braking device 10. When the leader of such next-following sheet reaches the drum 9 and its speed decreases to that which is indicated by the arrow B, the relative positions of such sheet and the preceding sheet cease to change, and the two sheets thereupon advance at the speed of the conveyor 7.

The convex surface 29 thereupon deflects the trailing portion 31T of the freshly decelerated sheet 31, and the same procedure is repeated, again and again, as long as the conveyors 1, 2 deliver discrete sheets and as long as the width of the clearances 132 is at least approximately uniform. The distance between the braking station and the path portion which is repeatedly traversed by the device 28 equals or approximates the length of a sheet 31.

When the first stream of sheets (between the conveyors 1 and 2) develops a relatively wide gap 32 (shown in the left-hand portion of FIG. 2), e.g., due to the absence of a single sheet 31 which has been removed for the purposes of inspection, due to detection of a defect or for another reason, a device 50 (e.g., a photocell) which monitors the path 3 upstream of the deflecting station C transmits a signal to the valve 326 which opens with a certain delay, namely, a delay which would be required to move the trailing portion of the missing sheet from the location of the monitoring device 50 to the space between the loop forming rolls 18 and 20. The operation of the mechanical deflecting device 28 need not be changed at all, i.e., the convex surface 29 of this deflecting device simply fails to meet and deflect the trailing portion of a sheet when the gap 32 arrives at the station C. The sheet 31 which precedes the gap 32 is braked in the same way as described in connection with FIG. 1, i.e., it is decelerated to the speed of the conveyor 7. However, and since a certain amount of time elapses between that instant when the trailing end of the sheet preceding the gap 32 was deflected by the convex surface 29 and the instant when the trailing portion of such sheet is overtaken by the leader of the sheet 31 following the gap 32, the trailing portion of the freshly braked sheet is likely or bound to return into the path 3 unless it is deflected again shortly prior to being overtaken by the oncoming rapidly advancing sheet (i.e., by the sheet which immediately follows the gap 32). Such renewed deflection is effected pneumatically by the suction chamber 21 whose internal space 24 is then connected to the intake of the pump 126 via pipe 25, manifold 26, nipple 27, conduit 226 and valve 326. It will be noted that the suction chamber 21 is located downstream of the station C, as considered in the direction of transport of sheets 31 along the path 3. The distance between the station C and the suction chamber 21 is selected in such a way (this distance can be adjusted by rotating the shaft 16 clockwise or counterclockwise) that the trailing portion 31T of the sheet which precedes the gap 32 and is braked by the device 10 is deflected not later than or is still deflected when the leader of the rapidly advancing oncoming sheet (i.e., the first sheet behind the gap 32) moves toward and past the suction chamber 21. This insures that the oncoming sheet can overlie the trailing portion of the preceding sheet in spite of the fact that it takes the oncoming sheet a little longer to catch up with the preceding sheet.

The exact manner in which the signal from the monitoring device 50 can be delayed to insure timely energization of the solenoid of the valve 326 forms no part of the invention. The time delay means may include a shift register or any other suitable means which can transport the energizing signal at the speed of sthe sheet 31 which follows a gap 32.

The position of the suction chamber 21 (i.e., the distance between this suction chamber and the station C) is a function of the ratio of the speed of conveyors 1 and 7 as well as a function of the format (length) of sheets 31 and of the width of clearances 132 between neighboring sheets 31 which are transported by the conveyors 1 and 2. When the width of clearances 132 and/or the length of sheets 31 and/or the ratio of speeds of the conveyors 1 and 7 changes, the shaft 16 is rotated clockwise or counterclockwise to move the suction chamber 21 toward or away from the station C, i.e., toward or away from the locus where the surface 29 of the mechanical deflecting device 28 moves across the path 3 upstream of the braking device 10. The adjustment can be carried out manually; such operation is normally performed simultaneously with a change of setup when the apparatus is prepared for the processing of shorter or longer sheets. As a rule, the ratio of the speeds A and B remains unchanged.

The extent to which the shaft 16 can move the suction chamber 21 between the braking device 10 and the mechanical deflecting device 28 can be readily selected in such a way that the properly shifted suction chamber 21 can deflect the trailing end of a sheet 31 which is separated from the next-following sheet by a distance equaling the combined width of two or more successive gaps 32. All that is necessary is to move the chamber 21 to a position in which the streams of air flowing into the holes 23 of the inclined top wall 22 attract the trailing portion 31T of the preceding (decelerated) sheet at the time when the trailing portion is approached by the leader 31L of the sheet which, during travel in the path portion between the conveyors 1, 2, was separated from the braked sheet by a distance equaling the combined width of several gaps 32.

It is further within the purview of the invention to install two or more shiftable suction chambers 21 between the mechanical deflecting device 28 and the braking device 10, especially if the distance between successive sheets in the path portion between the conveyors 1 and 2 equals the combined width of several (i.e., two, three or more) gaps 32. One of such plural suction chambers 21 deflects the trailing portion of a sheet which is separated from the next-following sheet by two gaps 32, another suction chamber deflects the trailing portion of a preceding sheet which is separated from the next-following sheet by three gaps, and so forth. The apparatus can employ two mechanical deflecting devices or two pneumatic deflecting devices. Also, the deflecting devices 21 and 28 can be respectively used for flexing of successive sheets 31 and for flexing of sheets which precede gaps 32.

In FIG. 2, the reference character D denotes the station or path portion for the single suction chamber 21. The reference characters 33 denote those parts of the second stream 5 wherein the trailing portion of the preceding sheet 31P was deflected by the suction chamber 21. It will be noted that the extent of overlap between each sheet 31P and the next-following sheet 31N is less than the extent of overlap between other sheets, i.e., those sheets which, during travel in the path portion between the conveyors 1 and 2, were separated solely by the relatively narrow clearances 132.

The apparatus which is shown in FIG. 3 can be simplified without affecting the accuracy of formation of the stream 5. Thus, the valve 326 and the monitoring device 50 can be omitted so that the suction chamber 21 is permanently connected with the suction generating device 126. The pressure in the internal space 24 of the chamber 21 is only slightly below atmospheric pressure. Alternatively, the valve 326 can be adjusted in such a way that the pressure in the space 24 is only slightly below atmospheric pressure even if the device 126 is capable of reducing the pressure in the chamber 21 to a much lower value.

The thus modified or adjusted apparatus operates as follows:

When the series of sheets 31 in the path 3 is free of gaps 32, the stream 5 is formed in the same way as described in connection with FIG. 1. However, the suction chamber 21 deflects the trailing end of each and every sheet 31 because the pressure in its internal space 24 is always below atmospheric pressure. This does not affect the formation of the stream 5 because the ports 23 merely attract the trailing portions 31T which are already overlapped by the next following sheets. The overlapping takes place between the mechanical deflecting device 28 and the loop forming roll 18. In other words, the chamber 21 automatically deflects the trailing portion of each and every sheet, regardless of whether such flexing is necessary. When a sheet 31P moves past the chamber 21, its trailing portion is deflected in a manner as described in connection with FIG. 2 in order to insure that the sheet 31P will be properly overlapped by the leader of the sheet 31N which follows the gap 32.

The suction chamber 21 cannot interfere with forward movement of the leader of the first sheet of a series of discrete sheets toward the braking device 10 because the pressure in the space 24 can be readily selected in such a way that the chamber 21 can only attract the trailing portions of sheets which move at a relatively low speed, i.e., which are braked by the device 10. When the leader of the foremost sheet of a series of sheets advances past the suction chamber 21 at the speed A, the chamber 21 is incapable of deflecting such leader into the looped portion 7A of the conveyor 7.

The pulley 4 preferably consists of a series of coaxial rollers which are separated from each other by annular spaces. Each roller of the pulley 4 guides a discrete belt of the conveyor 2. For example, the shaft 4A can carry an entire battery of coaxial rollers which together constitute the pulley 4. FIG. 3 further shows a nozzle 104 which is connected to a source 204 of pressurized fluid (preferably compressed air) and directs a stream or jet of compressed fluid in a direction toward the station for the suction chamber 21, namely, in substantial parallelism with the lower reach of the conveyor 1. Such jet insures that the leaders of successive sheets 31 readily advance above and beyond the pulley 6 on their way toward the braking device 10. Furthermore, when the surface 29 of the rotating mechanical deflecting device 28 deflects the trailing portion of a sheet 31, the jet of compressed air which issues from the nozzle 104 impinges upon the upper side of the deflecting trailing portion 31T and thus insures that such trailing portion cannot prematurely return into the path 1, i.e., that the trailing portion is still deflected when the leader of the next-following sheet catches up therewith.

It is clear that the apparatus can comprise two or more nozzles 104, e.g., at least one discrete nozzle between each pair of neighboring rollers which constitute the pulley 4.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

What is claimed is:

1. A method of forming a stream of partially overlapping flexible sheets, comprising the steps of transporting a series of discrete spaced-apart non-overlapping sheets at a relatively high first speed in a predetermined direction along a predetermined path; decelerating successive sheets of said series in a first portion of said path to a lower speed whereby each sheet following the respective preceding sheet in said first portion of said path catches up with the preceding sheet in a second portion of said path upstream of said first portion, as considered in said direction; deflecting the trailing portion of each preceding sheet at a first deflecting station as it travels at said lower speed past said first station and when there is no gap in said series of discrete sheets due to the absence of at least one sheet in said series, said deflection occuring substantially immediately before the following sheet catches up therewith so that the leader of each following sheet overlies the trailing portion of the respective preceding sheet before the following sheet enters into and is decelerated in said first portion of said path; and deflecting the trailing portion of a decelerated sheet as it travels at the lower speed past a second deflecting station downstream from said first station, as considered in said direction when said series of discrete sheets exhibits a gap as a result of the absence of at least one sheet in said series so that the trailing portion of the sheet preceding a gap is deflected substantially immediately before the sheet following such gap catches up therewith.

2. A method as defined in claim 1, wherein one of said deflecting steps includes mechanically deflecting the trailing portions of said preceding sheets.

3. A method as defined in claim 1, wherein one of said deflecting steps includes pneumatically diverting the trailing portions of said preceding sheets from said path.

4. A method as defined in claim 1, wherein said path is substantially horizontal and each of said deflecting steps includes flexing the trailing portions of said preceding sheets downwardly.

5. A method as defined in claim 1, further comprising the step of shifting the locus of deflection of sheets which precede gaps in said series of sheets in or counter to said direction as a function of changes in the ratio of said first and second speeds.

6. A method as defined in claim 1, wherein said last mentioned deflecting step includes establishing a pressure differential at the opposite sides of the trailing portion of the sheet which precedes a gap.

7. Apparatus for forming a stream of partly overlapping flexible sheets, comprising means for transporting a series of discrete spaced-apart non-overlapping sheets at a relatively high first speed in a predetermined direction along a predetermined path; means for decelerating successive sheets of said series in a first portion of said path to a lower second speed whereby each sheet following the respective preceding sheet which is located in said first portion catches up with the preceding sheet in a second portion of said path upstream of said first portion, as considered in said direction; means for deflecting the trailing portion of each preceding sheet as it travels at said lower speed from said path immediately before the respective following sheet catches up therewith so that the leader of the following sheet overlies the trailing portion of the respective preceding sheet before such following sheet reaches said first portion of said path; and means for deflecting the trailing portion of a decelerated sheet as it travels at said lower speed intermediate said first mentioned deflecting means and said decelerating means when said series exhibits a gap as a result of the absence of at least one sheet in said series so that the trailing portion of the sheet preceding a gap is deflected immediately before the sheet which follows such gap catches up therewith.

8. Apparatus as defined in claim 7 for forming a stream of partially overlapping sheets having a predetermined length, wherein said first mentioned deflecting means is spaced apart from said decelerating means by a distance which approximates the length of a sheet.

9. Apparatus as defined in claim 7, further comprising means for moving said last mentioned deflecting means in and counter to said direction intermediate said first mentioned deflecting means and said decelerating means.

10. Apparatus as defined in claim 9, wherein said moving means include a toothed rack extending in parallelism with said path, a pinion meshing with said rack, and means for rotating said pinion clockwise and counterclockwise.

11. Apparatus as defined in claim 7, wherein said last mentioned deflecting means comprises a suction chamber adjacent to one side of said path intermediate said first and second portions, suction generating means, and means for connecting said chamber with said suction generating means when a gap approaches said second portion of said path.

12. Apparatus as defined in claim 11, wherein said suction chamber has a foraminous wall adjacent to said path and sloping rearwardly and away from said path, as considered counter to said direction.

13. Apparatus as defined in claim 7, wherein said transporting means includes at least one conveyor arranged to transport said series of sheets at said first speed and at least one second conveyor arranged to transport said stream at said second speed, said second conveyor including a portion located opposite said first mentioned deflecting means and spaced apart from said second portion of said path to allow for deflection of trailing portions of successive sheets from said path.

14. Apparatus as defined in claim 7, wherein said last mentioned deflecting means is adjacent to one side of said path intermediate said first and second portions, and further comprising means for moving said last mentioned deflecting means in and counter to said direction, said moving means including a support for said last mentioned deflecting means and said transporting means including an endless flexible conveyor disposed at said one side of said path and means for looping a portion of said conveyor in the region of said last mentioned deflecting means.

15. Apparatus as defined in claim 14, wherein said looping means is mounted on said support.

16. Apparatus as defined in claim 14, wherein said last mentioned deflecting means includes means for diverting trailing portions of sheets which precede gaps in said series of sheets to said one side of said path so that each trailing portion which is diverted by said last mentioned deflecting means extends into the looped portion of said endless conveyor.

17. Apparatus as defined in claim 7, wherein said transporting means includes conveyors arranged to transport the sheets of said series at a substantially uniform distance from each other.

18. Apparatus as defined in claim 7, wherein said decelerating means includes a braking device and said braking device includes a portion of said transporting means.

19. Apparatus as defined in claim 7, wherein at least one of said deflecting means includes a rotary mechanical deflecting device.

20. Apparatus as defined in claim 7, wherein at least one of said deflecting means includes means for establishing a pressure differential at the opposite sides of trailing portions of the sheets.

21. Apparatus as defined in claim 7, wherein said last mentioned deflecting means comprises a suction chamber adjacent to said path, suction generating means, and means for permanently connecting said chamber to said suction generating means so that said chamber deflects the trailing portion of each and every sheet subsequent to deceleration of the respective sheet.

22. Apparatus as defined in claim 7, wherein said first mentioned deflecting means comprises means for diverting the trailing portions of successive sheets to one side of said path and further comprising means for discharging at least one jet of a gaseous fluid in substantial parallelism with and at said one side of said path ahead of said first mentioned deflecting means in a direction toward said decelerating means so that the gaseous fluid promotes the deflection of successive trailing portions immediately after diversion of such trailing portions by said first mentioned deflecting means and prolongs the intervals during which the trailing portions of successive sheets are diverted from said path.

* * * * *